US005844461A

United States Patent [19]

Faulk et al.

[11] Patent Number: 5,844,461

[45] **Date of Patent: *Dec. 1, 1998**

[54] ISOLATION TRANSFORMERS AND ISOLATION TRANSFORMER ASSEMBLIES

[75] Inventors: Richard A. Faulk, Cypress; Eddie B. Braddy, Jr., Plano, both of Tex.

[73] Assignee: Compaq Computer Corporation, Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 656,967

[22] Filed: Jun. 6, 1996

[51] Int. Cl.[6] ..... H01F 27/30; H01F 17/06; H01F 27/24

[52] U.S. Cl. ..... 336/206; 336/205; 336/178; 336/219

[58] Field of Search ..... 336/205, 232, 336/178, 206, 219

[56] References Cited

U.S. PATENT DOCUMENTS

| | | | |
|---|---|---|---|
| 535,105 | 3/1895 | Heath . | |
| 1,303,511 | 5/1919 | Shackelton . | |
| 1,965,330 | 7/1934 | Apple | 140/92.2 |
| 2,388,598 | 11/1945 | Cahill | 175/31 |
| 2,479,391 | 8/1949 | Miller | 140/92.2 |
| 2,930,014 | 3/1960 | Van Der Hoek et al. | 336/190 |
| 3,028,570 | 4/1962 | Taylor | 336/83 |
| 3,337,145 | 8/1967 | Keck | 242/7.11 |
| 3,635,411 | 1/1972 | Petrinjak et al. | 242/1 |
| 3,851,287 | 11/1974 | Miller et al. | 336/84 |
| 3,858,624 | 1/1975 | Sallin | 140/922 |
| 4,443,777 | 4/1984 | Koike | 336/65 |
| 4,536,734 | 8/1985 | Mabuchi | 336/196 |
| 4,583,068 | 4/1986 | Dickens et al. | 336/82 |
| 4,616,205 | 10/1986 | Praught et al. | 336/82 |
| 4,857,878 | 8/1989 | Eng, Jr. et al. | 336/192 |
| 4,859,978 | 8/1989 | Feather et al. | 336/186 |
| 4,864,486 | 9/1989 | Spreen | 336/126 |
| 4,914,561 | 4/1990 | Rice et al. | 363/126 |
| 5,010,314 | 4/1991 | Estrov | 336/198 |
| 5,559,487 | 9/1996 | Butcher et al. | 336/178 |

FOREIGN PATENT DOCUMENTS

| | | | |
|---|---|---|---|
| 719336 | 10/1965 | China | 336/232 |
| 3612-209 | 10/1987 | Germany | 336/206 |
| 3 283 404 | 12/1991 | Japan | 336/200 |
| 1 407 501 | 9/1975 | United Kingdom . | |
| 2 163 603 | 2/1986 | United Kingdom | 336/200 |

OTHER PUBLICATIONS

Dai, N., et al., *A Comparative Study of High–Frequency Low–Profile Planar Transformer Technologies,* 1993 VPEC Seminar Proceedings, Blacksburg, VA, pp. 153–161 (1993).

Green, J. et al., *Ferrites: Tips, Traps, Techniques, and Trends,* Seventh Annual Power Electronics Conference and Exposition, Profession Education Seminars Workbook (1992).

Vollin, J., et al., *Magnetic Regulator Modeling,* Eighth Annual Power Electronics Conference and Exposition, pp. 604–611 (1993).

*Primary Examiner*—Michael L. Gellner
*Assistant Examiner*—Anh Mai
*Attorney, Agent, or Firm*—Fish & Richardson P.C.

[57] ABSTRACT

An isolation transformer comprises two core pieces mounted to cooperate to provide flux paths, one of the core pieces being shaped so that a central flux path is defined by a central leg of the core, at least two magnetically coupled windings surrounding the central flux path, and an isolation layer sandwiched between the windings.

16 Claims, 11 Drawing Sheets

ISOLATION TRANSFORMERS AND ISOLATION TRANSFORMER ASSEMBLIES

BACKGROUND

This invention relates to isolation transformers and isolation transformer assemblies.

An isolation transformer is a transformer designed to provide magnetic or flux coupling between one or more pairs of isolated circuits, without introducing significant coupling of low frequency signals between them, such as either significant conductive or electrostatic coupling. Isolation transformers are typically used in power supplies of consumer electronic goods, such as personal computer systems, to isolate the user from the high voltage and current levels of AC power as required by regulatory agencies. When the isolation transformer is to be used in an application such as consumer electronics, where space is at a premium, it is important to have the transformer only occupy a minimum volume of space. In addition, the transformer must provide isolation between the circuits.

In order to achieve the desired isolation between primary and secondary circuits, the conventional construction of isolation transformers typically requires significant air gaps, creepage, and clearances to avoid conductive or capacitive coupling. Referring to FIGS. 1–2, one such conventional construction is a plastic bobbin 20, which includes a hollow cylindrical spindle 22 having a central hole 26 and two end rims 24 on either side of the spindle 22. The bobbin 20 is used in a conventional isolation transformer 28 as shown in FIG. 2. A length of Mylar tape having a width of about 2.5 mm is wound about the spindle 22 adjacent each end rim 24 to form a layer of tape 32 having the approximate height of the wire used for a primary winding 30. Next, magnetic wire is wound about the spindle 22 on its central portion between the layered tape side by side in a manner known to those skilled in the art to form the primary winding 30. Then, two layers of Mylar tape are wound on top of the primary winding 30 and the layered tape 32 to form a tape isolation layer 34 between the primary winding 30 and a secondary winding 38. Then, two other tape layers 36 having a width of about 2.5 mm are wound adjacent the end rims 24 on top of the tape isolation layer 34. Finally, magnetic wire is wound on top of the tape isolation layer 34 to form the secondary winding 38. A magnetic core 42 is inserted into the central hole 26 of the hollow spindle 22 to complete the isolation transformer of the prior art. The magnetic core 42 is mounted to provide a tolerance air space 40 between the core 42 and the windings 30 and 38 to allow for ease of assembly. The tape layers 32 and 36 are necessary to provide the appropriate clearance between the primary and secondary windings 30, 38 to account for creepage. In addition, wire sleeving or insulated sleeving must be installed on terminal leads of the primary and secondary windings, and further spacing may be required for conductive cores and other compounds.

Another conventional isolation transformer utilizes a two piece plastic bobbin to eliminate the labor involved with the wrapping of tape around the respective coils. Referring to FIG. 3, a conventional isolation transformer 50 using a two piece plastic bobbin is shown. A primary bobbin 56 includes a cylindrical primary spindle 64 with primary rims 66 mounted on either end. Magnetic wire is wound on the spindle 64 to form the primary winding 58. A secondary bobbin 60 includes a secondary spindle 68 and two secondary end rims 70 on either end. Again, magnetic wire is wound around the secondary spindle 68 to form the secondary winding 62. The secondary bobbin 60 also includes an extension tab 72 and flange lips 74 extending inward on one end of the secondary bobbin and forming a gap 76 between the flange lips 74 and the primary bobbin 56. The flange 76 is an appropriate size to receive the primary bobbin 56 so that the primary bobbin 56 fits within the secondary bobbin 60. Core material 52 has a cylindrical gap 54 in which the primary and secondary bobbins 56, 60 are placed with the gap 54 about a central area of the core material 52.

Planar magnetics have been developed to reduce the overall size and height of electronic devices such as isolation transformers. Referring to FIG. 4, a conventional isolation transformer 78 using planar magnetics for ease of assembly is shown. Two E-shaped ferrite core halves 80 each preferably comprises a relatively flat magnetic plate 81 with an inner rail or bar 84 and two outer bars 82 formed on either end of the plate 81. Two ferrite core halves 80 are aligned to face each other and to sandwich a plurality of windings, wherein the windings are fabricated using planar magnetics. In a first form of planar magnetics, primary windings 96 are etched or otherwise routed on a PCB board comprising an insulation material such as FR4, Mylar, or Kapton to form a primary board 90. The primary board 90 includes a central hole 102 to receive the inner bar 84 of the ferrite core halves 80. Likewise, a secondary winding 98 is etched on a secondary board 92 having a central hole 102 in a similar manner as the primary board 90. Other windings could be included, such as auxiliary winding 100 etched on an auxiliary board 94 as shown. The primary, secondary and auxiliary boards 90, 92 and 94 are joined or otherwise mounted together and sandwiched between the ferrite core halves 80 to form the isolation transformer 78 of prior art.

Referring to FIG. 5, an alternative form of planar magnetics is shown comprising a flex circuit 110 generally having an S-shape prior to folding. The flex circuit 110 includes etched traces 112 routed on the flex circuit 110, wherein the traces 112 eventually form the windings of the transformer. The flex circuit 110 comprises a mid-section 114 and an end section 116 and another end section 118 both separated from the mid-section 114 by fold lines 120 and 122, respectively. In assembly, a fold is made along line 120 so that the end section 116 is folded on top of the mid section 114, and then a fold is made at the line 122 so that the end section 118 is folded on top of the mid-section 114. Two or more sets of independent traces 112 are etched on the flex circuit 110 to form the primary, secondary and auxiliary windings, if desired. The folded flex circuit 110 is placed between the ferrite core halves 80 shown in FIG. 4.

SUMMARY OF THE INVENTION

In general, in one aspect, the invention features an isolation transformer having two core pieces mounted to cooperate to provide flux paths, one of the core pieces being shaped to define the central flux path, and one or more magnetically coupled windings surrounding the central flux path, and an isolation layer sandwiched between the two windings.

Implementations of this aspect of the invention may include the following features. The isolation layer may include adhesive on one side or on both sides. The isolation layer may comprise a piece of transfer adhesive tape. The isolation layer may include two pieces of insulating tape adhered together and adhered to a core piece on an exposed side of one of the pieces of tape. The windings may be free standing bondable windings. A third winding may surround the central flux path. A fourth winding may surround the central flux path. Both of the core pieces may be e-shaped.

In general, in another aspect, the invention features a primary winding mounted on a first core, a secondary winding mounted on a second core, an isolation tape layer sandwiched between and separating the primary and secondary windings and the two cores, and a support having a bottom surface and opposite side walls housing the coils and the cores.

Implementations of this aspect of the invention may include the following features. The support may include primary terminals and secondary terminals on opposite side walls. Primary leads may extend from the primary winding to the primary terminals, and secondary leads may extend from the secondary winding to the secondary terminals. One of the side walls may include wire channels for receiving leads extending from either of the windings. Insulating tape may be used to hold together the cores, windings, and support. The tape may be adjacent to the primary and secondary cores and wrap around the support.

In general, in another aspect, the invention features an insertion tool for receiving the isolation transformer, the tool having a channel along which the isolation transformer passes during insertion, the channel including a side wall, flanges flaring outward from an end of the channel to guide the isolation transformer into the channel and to fold the insulating tape, and the side wall having wire channels extending along the length of the wall.

Implementations of this aspect of the invention include the following features. The wire channels may be aligned with the wire channels of a support of the isolation transformer. The flanges may fold an isolation tape layer of the isolation transformer as the isolation transformer is fed into the channel. The wire channels may receive the wires of a winding of the isolation transformer.

In general, in another aspect, the invention features a method of assembling an isolation transformer by inserting an isolation transformer into an insertion tool at an upper end of the insertion tool and passing the isolation transformer along the insertion tool, and receiving the transformer in a transformer support adjacent the lower end of the insertion tool.

Implementations of this aspect of the invention include the following features. This aspect of the invention may feature a method of assembling an isolation transformer by folding an isolation tape layer of the transformer. This aspect of the invention may feature a method of assembling an isolation transformer by guiding the wires of a winding of the transformer as it passes along the length of the insertion tool. This aspect of the invention may feature a method of assembling an isolation transformer by folding a tape layer around the transformer and the support.

In general, in another aspect, the invention features an automated method of assembling an isolation transformer assembly by receiving a secondary winding coil and secondary core half, adhering an isolation tape layer on the secondary winding coil and secondary core half, receiving a primary winding coil and primary core half, adhering the primary winding coil and primary core half to the isolation tape layer to form an isolation transformer, placing the transformer into an insertion tool, and securing the transformer into a support to form the assembly.

In general, in another aspect, the invention features an automated isolation transformer assembly tool having a slot for holding the core halves of an isolation transformer, first and second knobs for securing the winding coils of an isolation transformer, and an isolation tape layer dispenser.

Implementations of this aspect of the invention include the following features. This aspect of the invention may feature an arm for lifting the transformer from the slot for insertion into a carrier. The assembly tool may comprise a carousel with multiple workstations. The carousel may be pivoted sideways.

Advantages of the invention may include one or more of the following. The isolation transformer is volume efficient, cost efficient, and easy and time efficient to manufacture. An isolation layer may be used to keep the windings in place and provide the required isolation barrier, eliminating the need for margin tape, tolerance airspace and large creepage clearances. The isolation layer provides full isolation between the primary and secondary windings and also serves to conveniently hold the core halves together. The isolation transformer is manufactured in a manner to reduce the space that the transformer occupies in power supplies.

An insertion tool is useful for placing an isolation transformer into a support. An insertion tool easily guides the windings of a transformer so that they may be connected to the terminals on a support. An insertion tool easily and precisely folds the isolation tape layer of the isolation transformer upwards.

An automated method of manufacturing an isolation transformer is useful for increasing the efficiency of producing the transformers.

Other advantages and features will become apparent from the following description and from the claims.

DESCRIPTION

Figure 2:
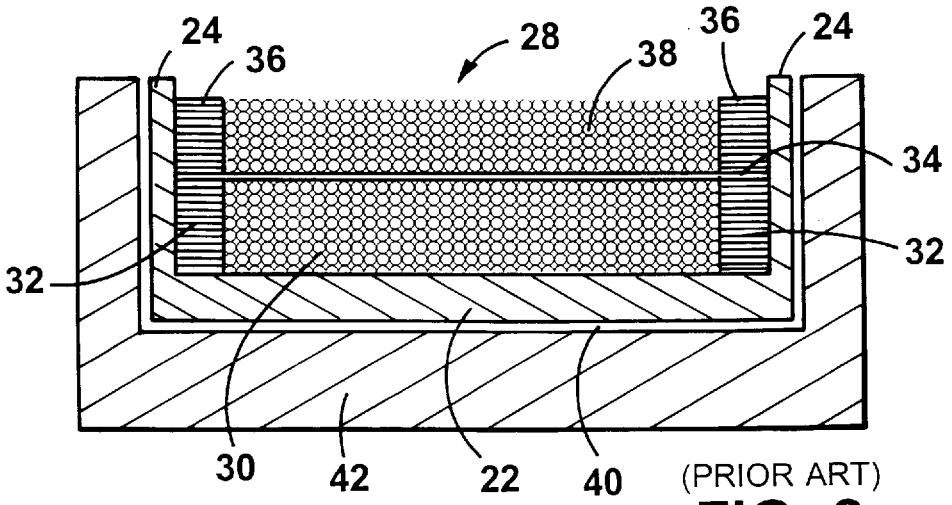
(PRIOR ART) FIG. 2
FIG. 2 is a cross-sectional side view of the upper half of a conventional transformer using the plastic bobbin in FIG. 1.
Figure 3:
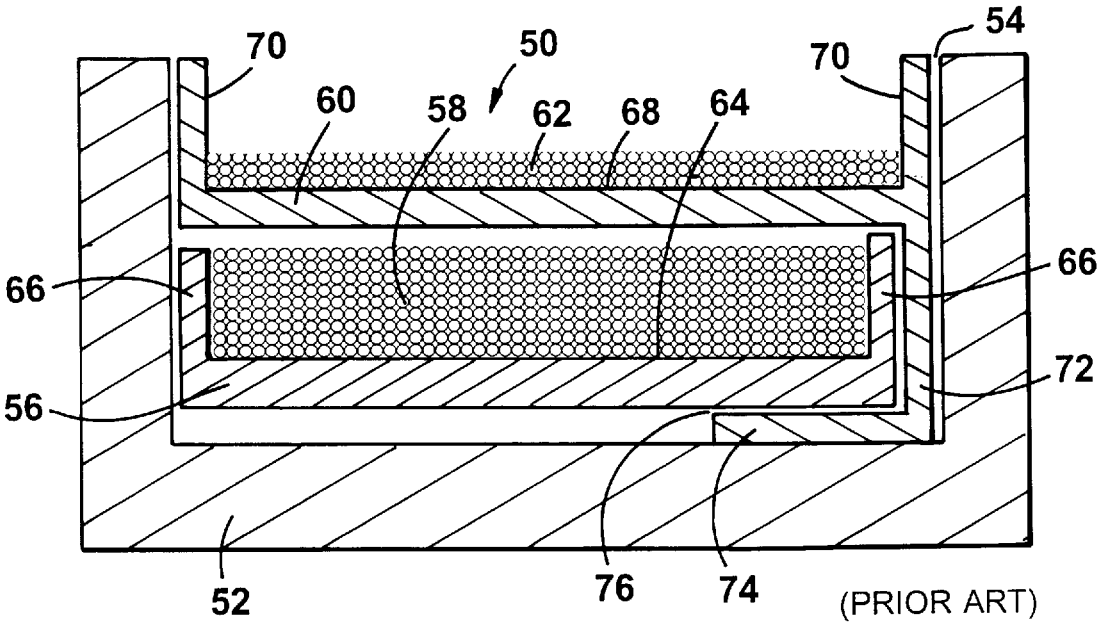
(PRIOR ART) FIG. 3
FIG. 3 is a cross-sectional side view of a conventional isolation transformer using a two piece plastic bobbin.
Figure 1:
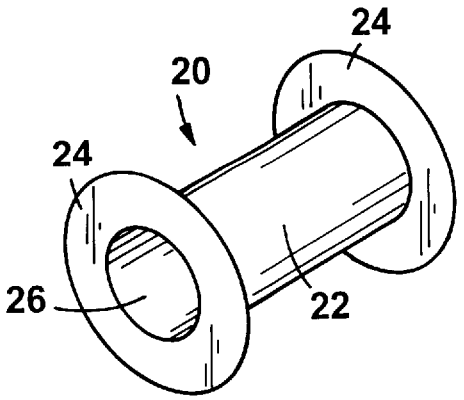
(PRIOR ART) FIG. 1
FIG. 1 is a perspective view of a plastic bobbin used in a conventional isolation transformer.
Figure 4:
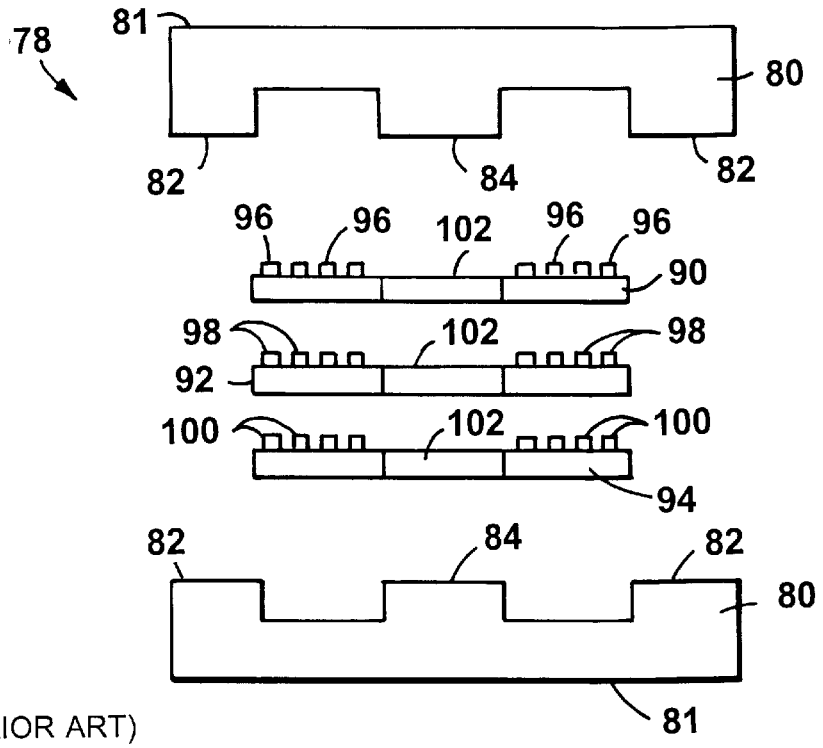
(PRIOR ART) FIG. 4
FIG. 4 is an exploded front view of a conventional transformer incorporating planar magnetics.
Figure 5:
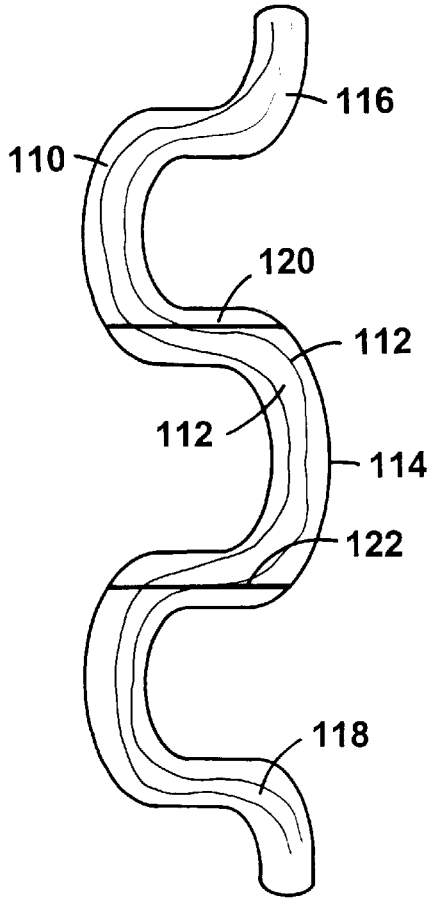
(PRIOR ART) FIG. 5
FIG. 5 is a side view of conventional transformer windings using flex circuit with traces.
Figure 6:
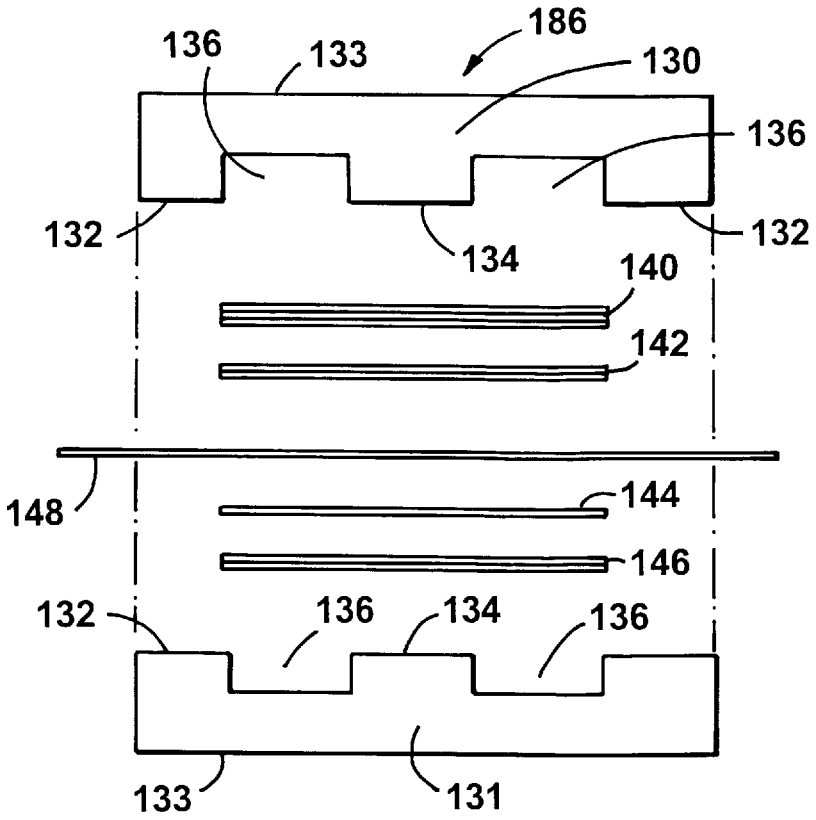
FIG. 6 is an exploded side view of an isolation transformer.

In the isolation transformer 186 of FIG. 6, two opposing E-shaped ferrite core halves 130 and 131 sandwich primary winding coils 140, 142, an isolation tape layer 148 and secondary winding coils 144, 146. The ferrite core halves 130, 131 are significantly smaller than the E-shaped core halves 80 used in a conventional transformer as shown in FIG. 4. The core halves 130, 131 may be C-shaped, pot-core shaped, PQ-core shaped or of any other magnetic shape. The primary and secondary ferrite core halves 130 and 131 include a flat magnetic plate 133 on one side, two outer walls 132 and a center wall 134, forming two gaps 136 on the opposite side between center wall 134 and the two outer walls 132. Walls 132, 134 and 136 are parallel to each other and approximately the same height. The planar topology of the isolation transformer 186 does not require bobbins or margin tape, thus allowing for a compact assembly.

The primary winding coils 140, 142 fit within the gaps 136 of the primary ferrite core half 130. The coils 140, 142 fit with a tight tolerance. An isolation tape layer 148 is then placed across the outer and center walls 132, 134 of the primary ferrite core half 130 to hold the coils 140, 142 in place. Similarly, the secondary winding coils 144, 146 are aligned with the center wall 134 of the secondary ferrite core half 131, and the primary and secondary cores 130, 131 are placed together so that the ends of the outer and center walls 132, 134 contact the isolation tape layer 148. The isolation tape layer 148 includes adhesive on both sides to hold the respective core halves 130, 131 together before final assembly. The isolation tape layer 148 is longer than the length of the core halves to account for required creepage. The isolation tape layer 148 provides appropriate isolation between the primary and secondary core halves 130, 131. Although the number of primary and secondary coils may vary depending on the isolation transformer configuration, an isolation transformer includes at least one primary winding coil and one secondary winding coil.

Figure 7:
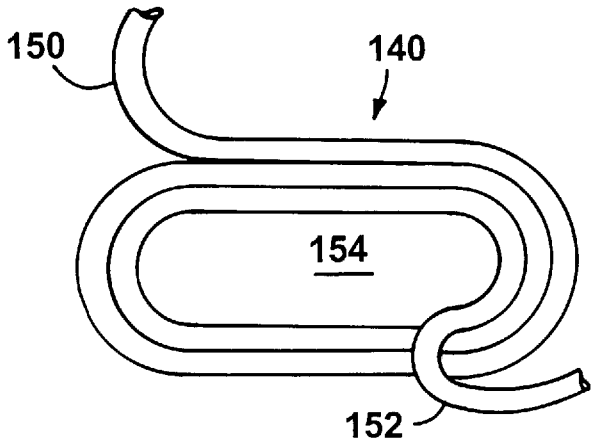
FIG. 7 is a top view of a bondable free standing winding used in the transformer assembly of FIG. 6.

Referring also to FIG. 7, the winding coils 140, 142, 144, 146 are elliptical, forming a hole 154, and are configured to be tightly held within their respective E-shaped core halves 130, 131. The winding coils 140, 142, 144, 146 are shaped to closely fit center wall 134, and their shape may vary with the shape of core halves 130, 131. The cross-sectional area of the center wall 134 of the isolation transformer 186 may be increased, thereby reducing the number of turns in winding coils 140, 142, 144 and 146. The winding coils 140, 142, 144, 146 are formed from bondable magnetic wire which is wound in a single layer to form a bonded free standing winding. The coil 140 does not flex easily but is a free standing winding due to the bonding material placed on the wire for ease of assembly of the transformer. The ends 150, 152 of the wire forming the coil 140 are separated from the coil 140 for access to external circuitry. In this manner, a worker may readily handle the coils 140, 142, 144 and 146 for ease of placement and manufacture of an isolation transformer.

Figure 8:
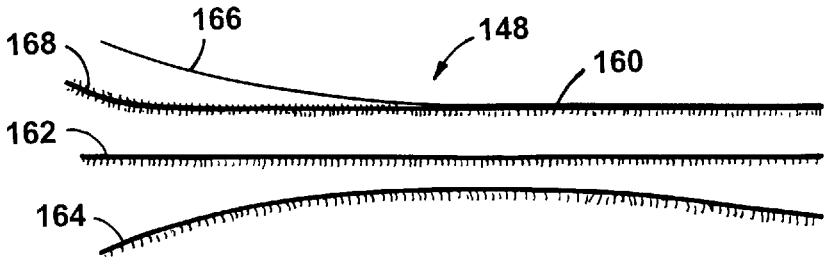
FIG. 8 is an exploded side view of an isolation tape layer for use in a transformer.

Referring to FIG. 8, the isolation tape layer 148 includes two pieces of standard electrical tape 162, 164 and one layer of transfer adhesive 160. Electrical tape 162 is sandwiched between transfer adhesive 160 and electrical tape 164. Each layer of tape 160, 162, 164 includes adhesive on its bottom surface. The transfer adhesive 160 has a layer of release paper 166 along its top surface instead of Mylar tape. When the 3 layers 160, 162 and 164 are properly aligned and adhered together, the release paper is removed, leaving an adhesive layer 168 along the top surface of tape layer 160. As a result, the isolation tape layer 148, which is comprised of two layers of tape in thickness also includes adhesive on its top and bottom surfaces. The isolation tape layer 148 is made to meet agency and safety requirements. Because the isolation tape layer 148 is comprised of more than a single layer of tape, according to federal agency standards, each layer of tape must provide 3000 volts of isolation within a specified creepage distance between the primary and secondary windings. The thickness of the resultant isolation tape layer 148 is in the range of 2.5 to 4 mils thick. The isolation tape layer 148 may be substituted with another isolation barrier sandwiched between the two core halves 130, 131.

Figure 9C:
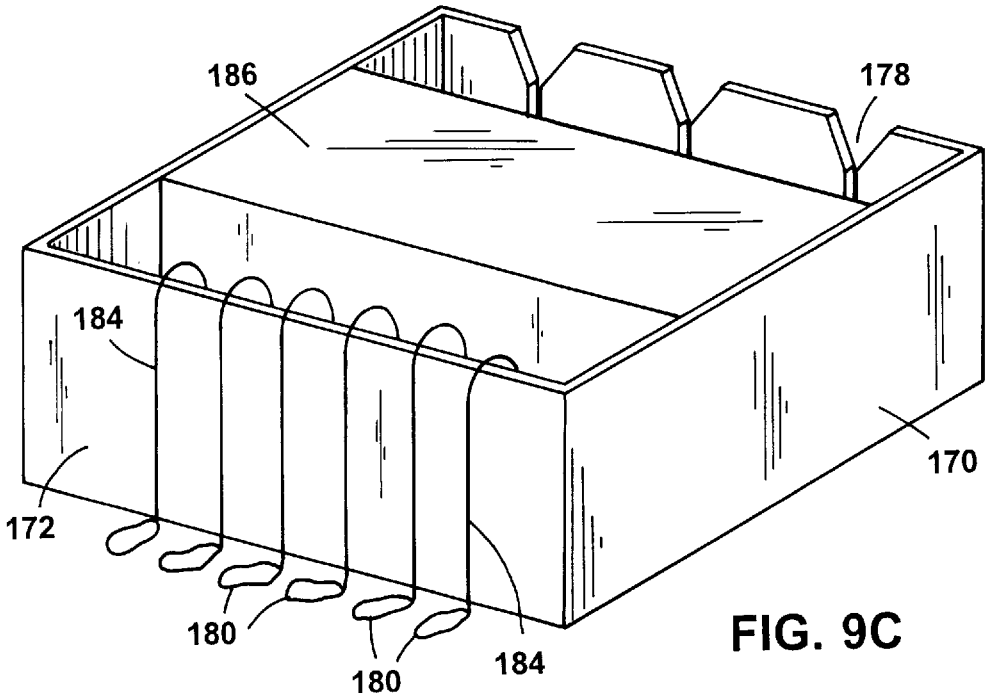
FIGS. 9A, 9B and 9C are perspective and first and second side views of a transformer assembly.
Figure 9A:
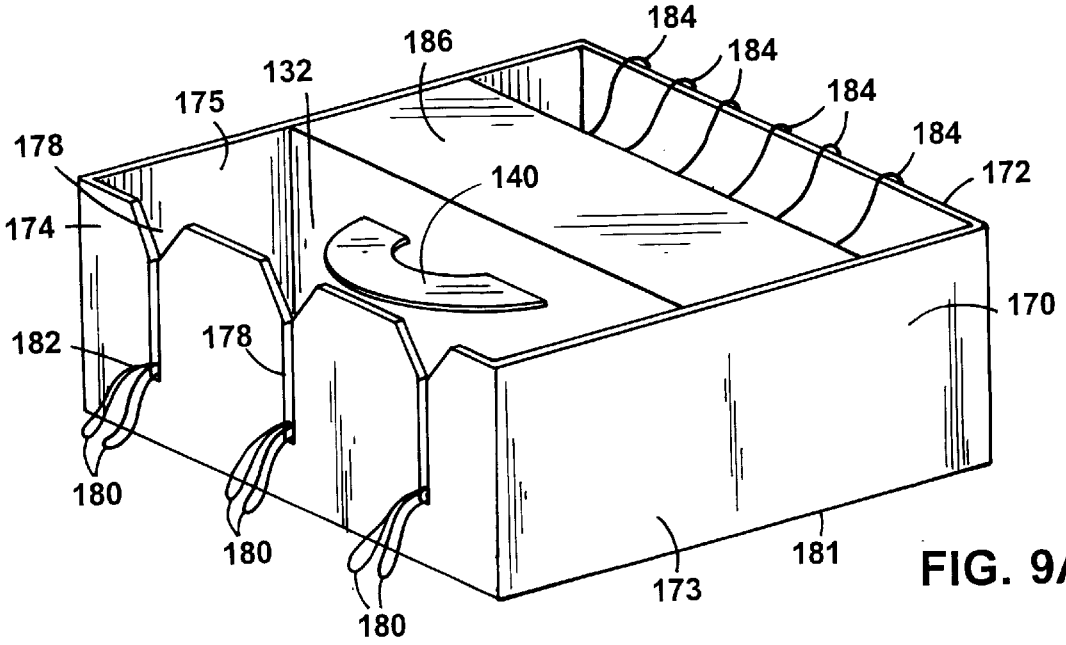
Figure 9B:
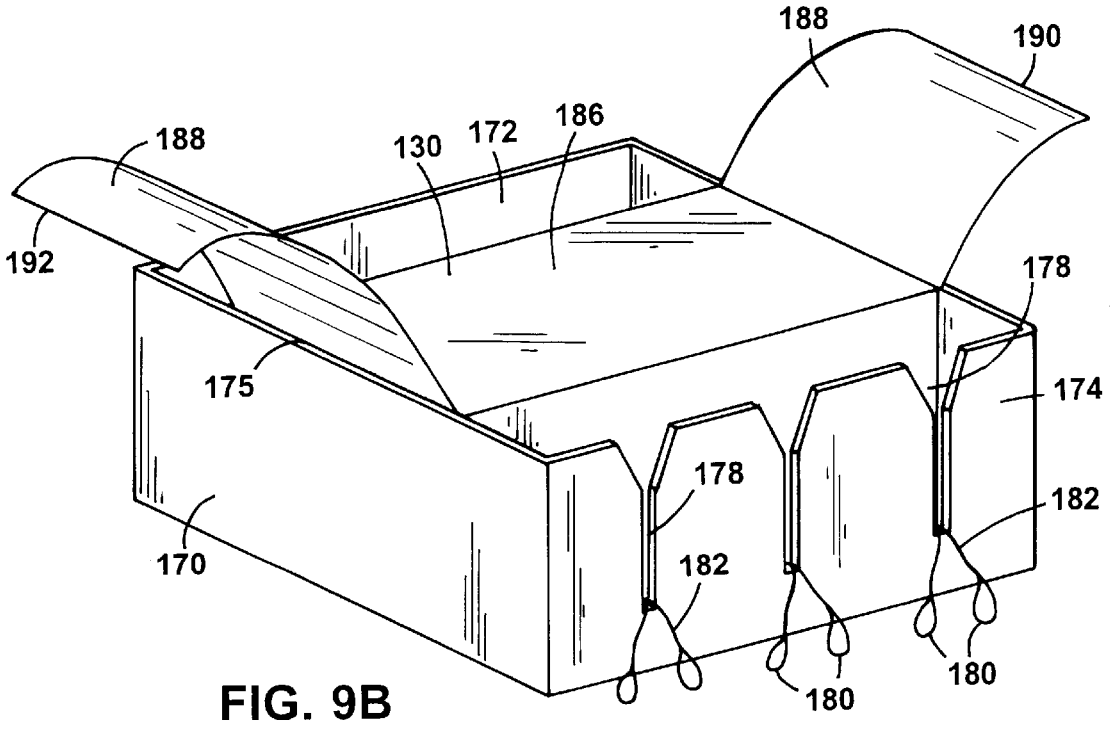
Figure 10A:
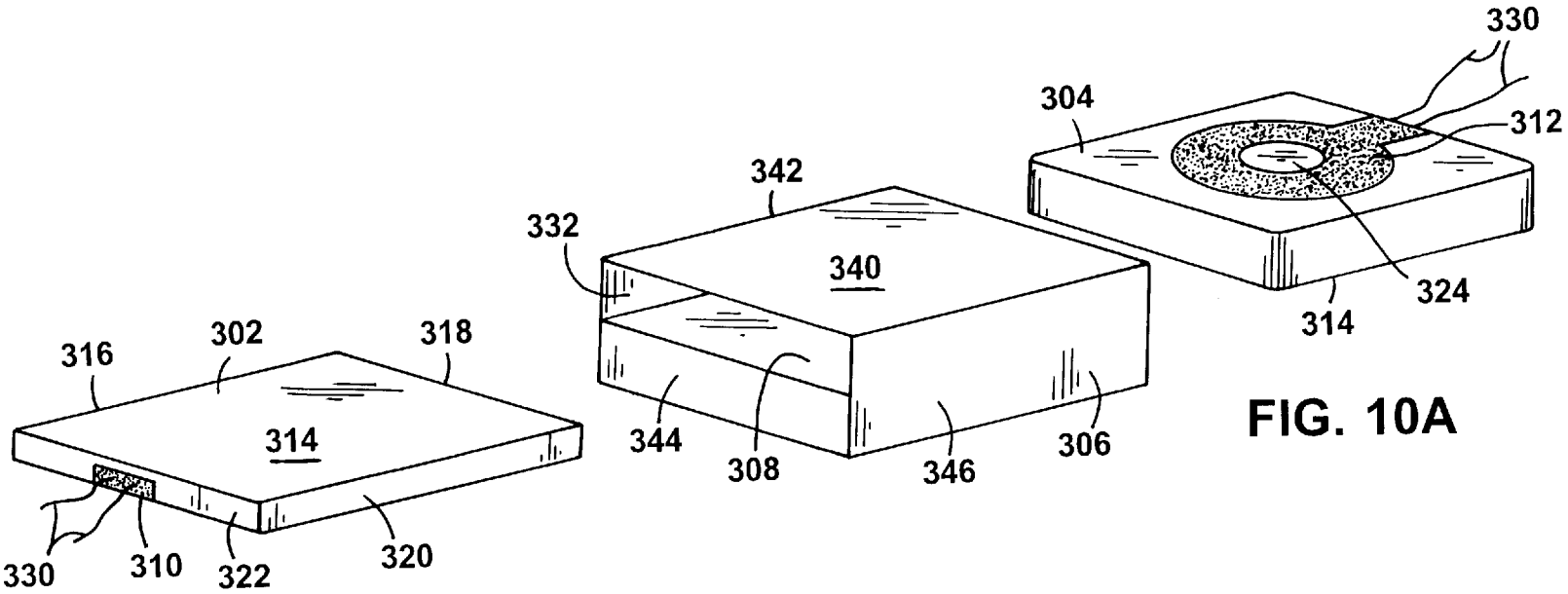
FIG. 10A is an exploded perspective view of an isolation transformer.
Figure 10B:
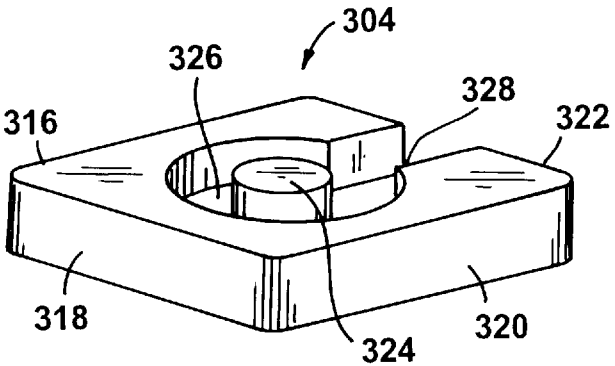
FIG. 10B is a perspective view of a core half for use in the isolation transformer of FIG. 10A.
Figure 10C:
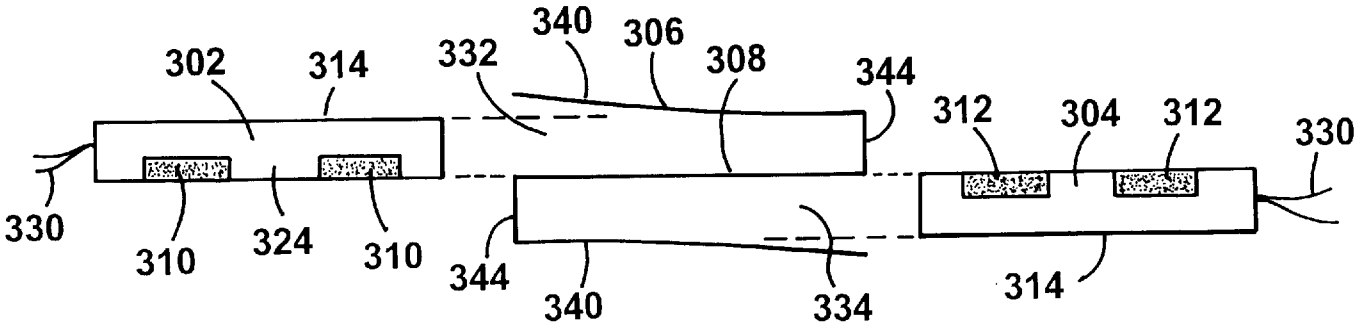
FIG. 10C is an exploded cross-sectional view of the isolation transformer of FIG. 10A.
Figure 10D:
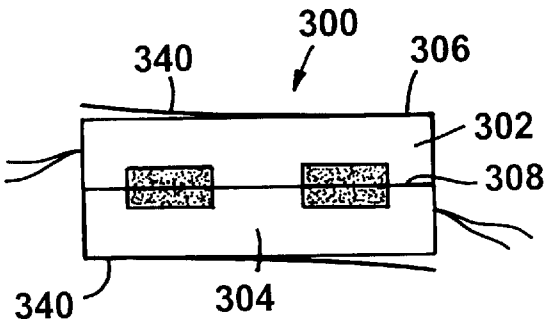
FIG. 10D is a cross-sectional view of the isolation transformer of FIGS. 10A and 10C.
Figure 11A:
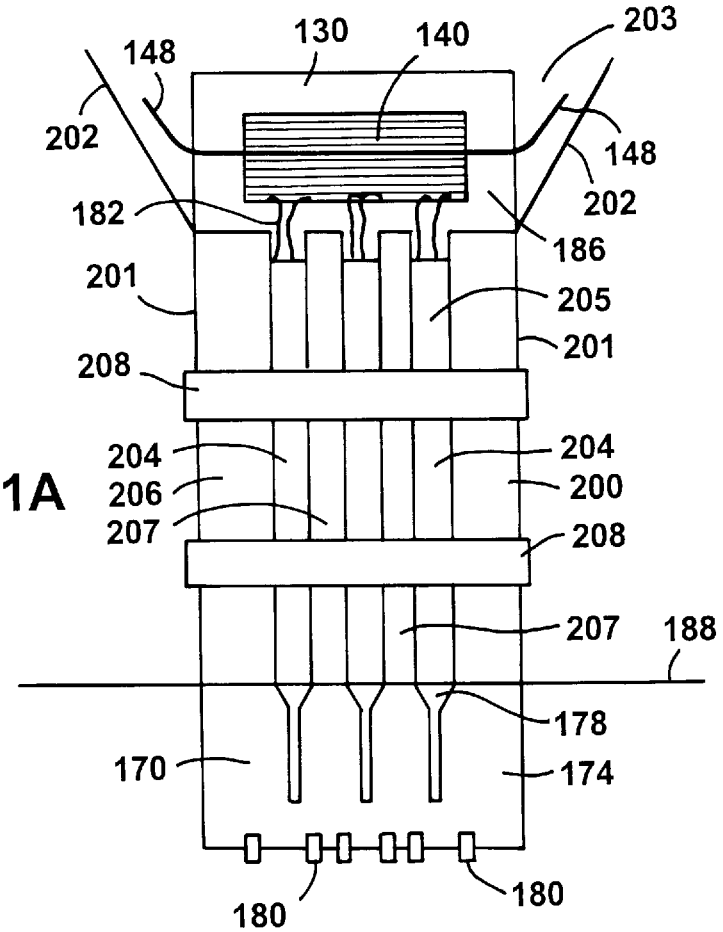
FIGS. 11A and 11B are opposing side views of an insertion tool for inserting a transformer into a carrier.
Figure 11B:
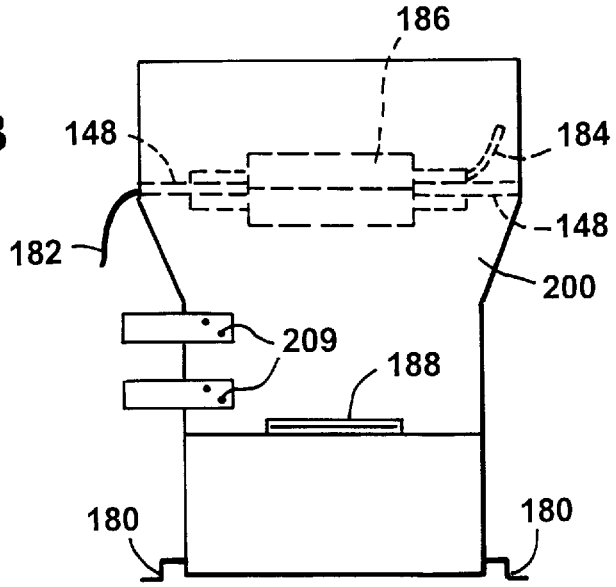
Figure 11C:
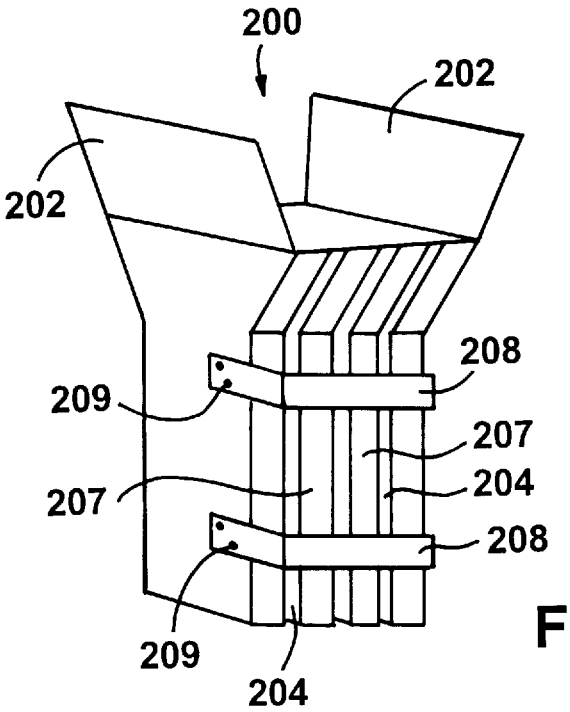
FIG. 11C is a perspective view of the insertion tool.
Figure 11D:
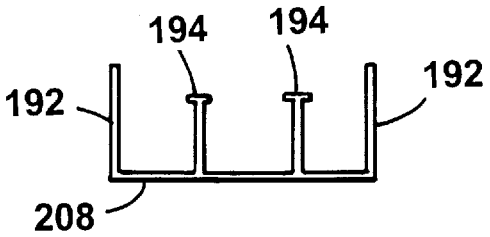
FIG. 11D is a top view of a bracket used on the insertion tool.

Referring to FIGS. 9A, 9B and 9C, the transformer 186 is placed within a carrier 170. The carrier 170 is a rectangular plastic box and is sized according to the size of the transformer 186. The carrier includes a bottom surface 181 and four side walls 172, 173, 174, 175 substantially perpendicular to each other and the bottom surface 181. First opposing sides walls 173 and 175 include smooth surfaces and are formed to be adjacent the outer walls 132 of the transformer 186. Second opposing side walls 172, 174 are adjacent the primary and secondary windings, respectively. Side wall 172, which is on the secondary wire side of the carrier 170 includes wire channels 178. The wire channels 178 are tapered outward along the periphery of the carrier 170. Side wall 174, which is on the primary wire side of the carrier 170, is a smooth surface. Side walls 172 and 174 include surface mount pins 180 along the bottom of the walls 172 and 174. The pins 180 of the secondary wire side are aligned with the individual wire channels 178.

The transformer 186 is inserted into the carrier so that the bottom surface of secondary core half 131 is adjacent the bottom surface 181 of the carrier 170 and the top surface of the primary core half 130 is approximately level with the top of the side walls 172, 173, 174 and 175 of the carrier 170. The wires 182 of secondary windings 144 and 146 are inserted in their respective wire channels 178 so that they contact their respective surface mount pins 180. The wires 184 of primary windings 140 and 142 are placed over opposing wall 172 of the plastic carrier 170 so that they contact their respective surface mount pins 180. Then the wires 182 and 184 may be soldered to the pins 180.

As shown in FIG. 9B, the transformer assembly may further include a piece of tape 188 for final assembly. The tape 188 is placed across the plastic carrier 170 prior to insertion of the transformer 186 so that the tape 188 may be wrapped around the transformer 186 and plastic carrier 170. Once the transformer 186 is secured within the carrier 170, first end 190 of the tape 188 is folded across the top of the transformer 186. The opposing end 192 of the tape 188, which is longer than the end 190 is wrapped across the top of the transformer 186 and around the plastic carrier 170 to secure the assembly.

Other types of isolation layers instead of isolation tape layer 148 may be used. For example, referring to FIGS. 10A–10D, an isolation transformer 300 includes ferrite core halves 302 and 304, carrier 306 having an isolation layer 308, and winding coils 310 and 312. Core halves 302 and 304 are rectangular in shape and include a flat magnetic plate 314 on one side, outer walls 316, 318, 320 and 322, and center wall 324. The outer walls 316, 318, 320 and 322 and center wall 324 form a central gap 326 for receiving a winding coil 310 or 312. Wall 322 includes a recess 328 for receiving the distal ends 330 of the winding coils 310 and 312. Winding coils 310 and 312 fit with a tight tolerance within the central gap 326 of core halves 302 and 304, respectively. The coils 310 and 312 are positioned so that the distal ends 330 of the coils 310 and 312 fit through recess 328. Central wall 324 may be circular in shape depending on the shape of winding coils 310 or 312.

Primary winding coil 310 fits within primary core half 302. Secondary winding coil 312 fits within secondary core half 304. Carrier 306 includes a primary compartment 336 and a secondary compartment 338 which are separated by isolation layer 308. Isolation layer 308 forms the bottom surface of primary compartment 336 and the top surface of secondary compartment 338. Each core half 302 and 304 slides into a compartment 332 or 334 of carrier 306. Each compartment 336 and 338 is formed to securely hold the primary and secondary core halves 302 and 304, respectively. Each compartment 336 and 338 includes an outer surface 340 which is approximately parallel to isolation layer 308. Each compartment 336 and 338 also includes three side walls 342, 344 and 346, which along with the outer surface 340 and isolation layer 308 form compartments 336 and 338. The outer surface 340 is bowed toward isolation layer 308 to secure the core halves 302 and 304 in place within carrier 306.

Referring to FIGS. 11A–11D, an insertion tool 200 may be used for facilitating the insertion of the transformer 186 into the plastic carrier 170. The insertion tool 200 is funnel-like in shape and includes an upper portion and a lower portion. The upper portion includes flanges 202 which flare outward on opposing sides of the upper portion. The flanges 202 form an opening 203 into which the transformer 186 is inserted. The lower portion forms a channel 205, which is formed by a pair of opposing walls 201 and 206. First opposing walls 201 extend downward from flanges 202. Second opposing walls 206 are perpendicular to walls 201. Walls 206 are formed to align with the primary and secondary side walls 172 and 174 of the carrier 170. One of secondary walls 206 includes vertical slots 204, which are spaced so that they may align with wire channels 178 of the plastic carrier 170. The vertical slots 204 are formed by wall portions 207, which are supported by brackets 208. Wall portions 207 extend along the length of the secondary wall 206. Brackets 208 include fasteners 209 for securing the brackets to insertion tool 200. The brackets 208 are U-shaped with the legs 192 of the U attached to first opposing walls 201. Each bracket 208 includes supports 194 which are adhered to wall portions 207. The supports 194 are approximately parallel to the legs 192 of the bracket 208. First opposing walls 201 are angled outward in a trapezoidal manner such that the distance across the bottom of the lower portion is approximately the length of the carrier and the distance across the top of the lower portion is about equal to the distance across the flanges 202 of the top portion. The lower portion of the insertion tool 200 is box-like and is sized to fit the carrier 170.

To use the insertion tool, the transformer 186 is inserted within the channel 205 of the insertion tool 200 and the wires 182 of secondary windings 144 and 146 are aligned with the corresponding slots 204 for insertion into the plastic carrier 170. Flanges 202 are angled to fold the edges of tape layer 148 extending from the outer walls 132 of the transformer 186 upwards. Walls 206 of the lower portion fold the edges of tape layer 148 extending along the length of transformer 186 upwards. Tape 188 may be placed between the plastic carrier 170 and the insertion tool 200 so that once the transformer 186 is inserted into the plastic carrier 170, tape 188 is folded upwards as shown in FIG. 9B.

Figure 12A:
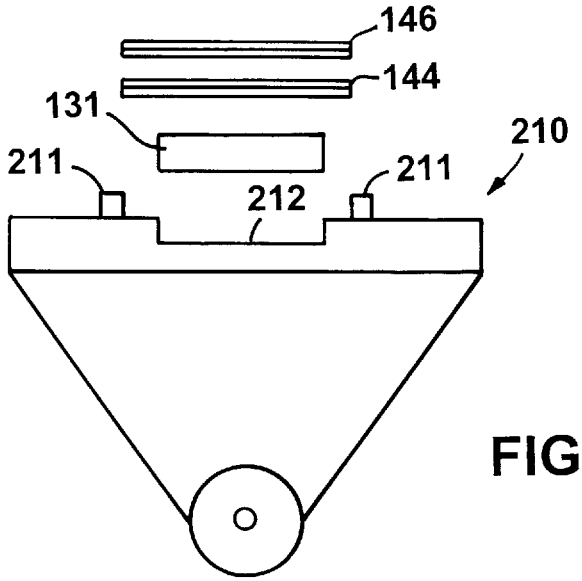
FIGS. 12A–12E are side views of an automatic assembly tool for assembling a transformer assembly.
Figure 12B:
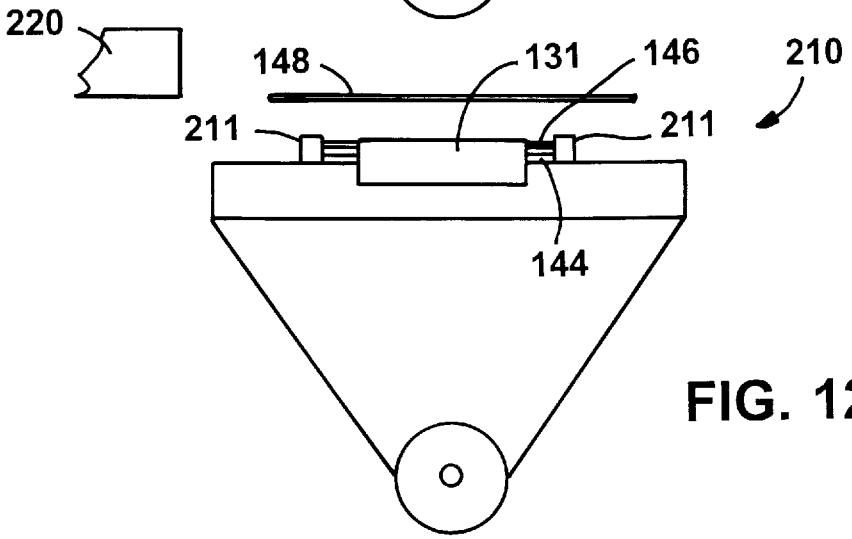
Figure 12C:
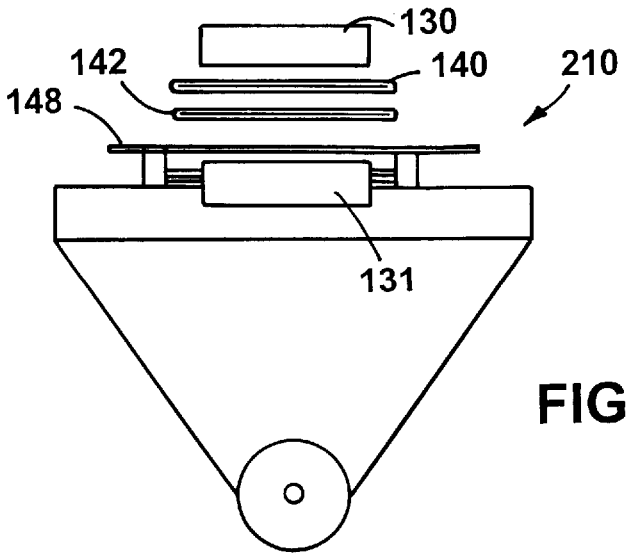

Referring to FIGS. 12A–12E, an automatic assembly tool 210 may be used to efficiently assemble multiple isolation transformers. The assembly includes multiple stations for performing the steps for assembling a transformer assembly. In one example, the assembly is a carousel with five workstations. The workstations each include a slot 212 which is shaped to securely hold core halves 130 and 131. These workstations also include first and second knobs 211 which are spaced to hold the windings of the transformer 186 in place. In operation, the secondary ferrite core half 131 is inserted into slot 212 of the tool 210 (FIG. 12A). Then, the secondary winding coils 144 and 146 are placed on top of the core half 131 so that the holes 154 are aligned with the center bar 134. Next, isolation tape layer 148 is placed on top of secondary core half 131, by standard automated tape dispensing equipment 220 (FIG. 12B). The primary winding coils 140, 142 are then placed on top of the tape layer 148, and the primary core half 130 is then placed on top of the primary winding coils 140, 142 using standard pick and place equipment (FIG. 12C).

Figure 12D:
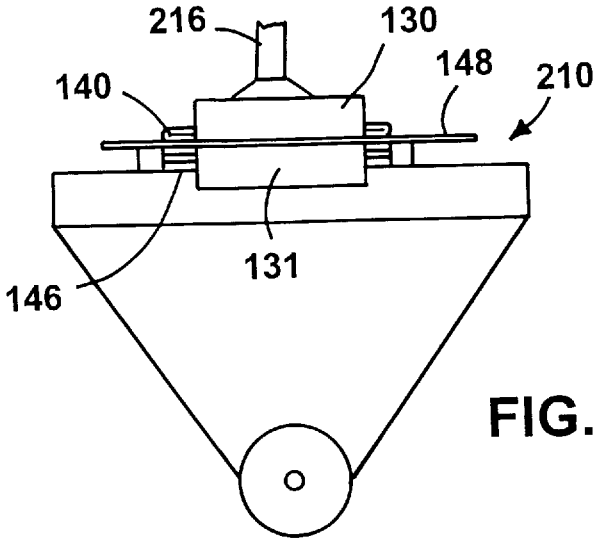
Figure 12E:
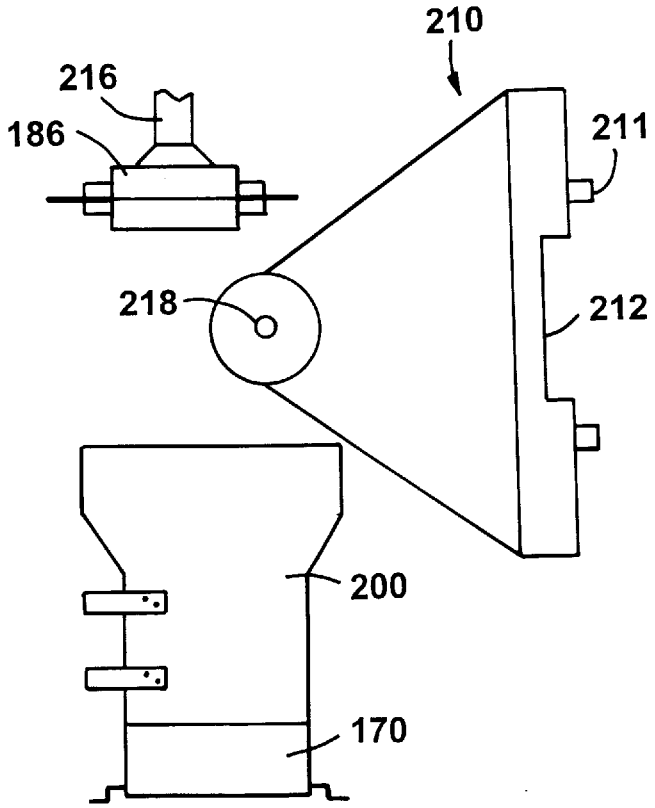

Then, an arm 216 is lowered onto the transformer 186 to lift the transformer 186 from the tool 210 (FIG. 12D). As shown in FIG. 12E, the tool 210 includes a hinge 218. Once the transformer assembly 186 is lifted off the platform 210, the tool 210 is pivoted sideways either manually or automatically about the pivot point of hinge 218. Arm 216 then lowers the transformer 186 into the insertion tool 200 for placement into the plastic carrier 170 as described previously.

Other embodiments are also within the scope of the following claims.

What is claimed is:

1. An isolation transformer comprising two E-shaped core pieces mounted to cooperate to provide flux paths, one of the core pieces having a leg defining a portion of one of the flux paths, at least two magnetically coupled windings surrounding said one of the flux paths, and an isolation layer located between the windings and between the leg of one of the core pieces and the other core piece.

2. The isolation transformer of claim 1 wherein the isolation layer includes adhesive on one side.

3. The isolation transformer of claim 1 wherein the isolation layer includes adhesive on both sides.

4. The isolation transformer of claim 1 wherein the isolation layer comprises a piece of transfer adhesive tape.

5. The isolation transformer of claim 1 wherein the isolation layer includes two pieces of insulating tape adhered together and adhered on an exposed side of one of the pieces of tape.

6. The isolation transformer of claim 1, wherein the windings comprise free standing bondable windings.

7. The isolation transformer of claim 1 further comprising a third winding surrounding said one of the flux paths.

8. The isolation transformer of claim 1 further comprising third and fourth windings surrounding said one of the flux paths.

9. The isolation transformer of claim 1, wherein one of the core pieces is E-shaped.

10. The isolation transformer of claim 1 wherein both of said core pieces are E-shaped.

11. The isolation transformer of claim 1, wherein the leg comprises a central leg.

12. The isolation transformer of claim 1, wherein the leg comprises a first central leg, said other core piece includes a second central leg configured to cooperate with the first central leg to define a central flux path, and the isolation layer is located between the first and second central legs.

13. The isolation transformer of claim 1, wherein the isolation layer comprises a single integrated sheet.

14. The isolation transformer of claim 1, wherein the isolation layer is in contact with the leg and said other core piece.

15. The isolation transformer of claim 1, wherein the isolation layer is of a sufficient size to meet a predetermined creepage requirement.

16. An isolation transformer comprising:

a first E-shaped core piece having a central leg;

a second E-shaped core piece having a central leg mounted to cooperate with the central leg of the first E-shaped core piece to provide a central flux path;

at least two magnetic ally coupled and free standing bondable windings surrounding the central flux path; and an isolation layer formed from a single integrated sheet, the isolation layer located between the windings and between the leg of one of the core pieces and the other core piece, the isolation layer including adhesive on one side and contacting at least one of the central legs.

* * * * *